US008210908B2

(12) United States Patent
Hashish

(10) Patent No.: US 8,210,908 B2
(45) Date of Patent: Jul. 3, 2012

(54) VENTED CUTTING HEAD BODY FOR ABRASIVE JET SYSTEM

(75) Inventor: Mohamed Hashish, Bellevue, WA (US)

(73) Assignee: Flow International Corporation, Kent, WA (US)

( * ) Notice: Subject to any disclaimer, the term of this patent is extended or adjusted under 35 U.S.C. 154(b) by 1045 days.

(21) Appl. No.: 12/144,489

(22) Filed: Jun. 23, 2008

(65) Prior Publication Data

US 2009/0318064 A1 Dec. 24, 2009

(51) Int. Cl.
*B24C 5/04* (2006.01)

(52) U.S. Cl. ..... 451/102; 451/38

(58) Field of Classification Search ..... 451/102
See application file for complete search history.

(56) References Cited

U.S. PATENT DOCUMENTS

| | | | | |
|---|---|---|---|---|
| 2,985,050 | A | 5/1961 | Schwacha | |
| 4,165,587 | A | 8/1979 | Cottingham et al. | |
| 4,478,368 | A | 10/1984 | Yie | |
| 4,555,872 | A | 12/1985 | Yie | |
| 4,563,840 | A | 1/1986 | Urakami | |
| 4,648,215 | A | 3/1987 | Hashish et al. | |
| 4,711,056 | A | 12/1987 | Herrington et al. | |
| 4,951,429 | A * | 8/1990 | Hashish et al. | 451/102 |
| 4,955,164 | A | 9/1990 | Hashish et al. | |
| 5,320,289 | A * | 6/1994 | Hashish et al. | 451/102 |
| 5,469,768 | A | 11/1995 | Schumacher | |
| 5,643,058 | A | 7/1997 | Erichsen et al. | |
| 5,851,139 | A | 12/1998 | Xu | |
| 6,000,308 | A | 12/1999 | LaFountain et al. | |
| 6,077,152 | A | 6/2000 | Warehime | |
| 6,280,302 | B1 | 8/2001 | Hashish et al. | |
| 6,875,084 | B2 | 4/2005 | Hashish et al. | |
| 2003/0037650 | A1 | 2/2003 | Knaupp et al. | |
| 2003/0037654 | A1 | 2/2003 | Sciulli et al. | |
| 2004/0235395 | A1 | 11/2004 | Hashish et al. | |
| 2005/0017091 | A1 * | 1/2005 | Olsen et al. | 239/400 |
| 2007/0119992 | A1 | 5/2007 | Hashish | |

FOREIGN PATENT DOCUMENTS

| | | | |
|---|---|---|---|
| EP | 0119338 | A1 | 9/1984 |
| EP | 0375887 | B1 | 7/1990 |
| EP | 0391500 | A2 | 10/1990 |
| EP | 1422026 | B1 | 5/2004 |
| WO | 9219384 | A1 | 11/1992 |

* cited by examiner

*Primary Examiner* — Maurina Rachuba
(74) *Attorney, Agent, or Firm* — Seed IP Law Group PLLC

(57) ABSTRACT

An abrasive waterjet assembly has a cutting head assembly with a venting system for controlling the flow of abrasive within a cutting head body. The venting system includes one or more vents for regulating the pressure within a cutting head body to minimize, limit, or substantially eliminate any abrasive from reaching a jewel orifice. The vents include venting ports positioned between an orifice mount that retains the jewel orifice and a mixing region in which abrasive is mixed with a fluid jet produced by the jewel orifice. An isolator retained in the cutting head body further inhibits the upstream flow of abrasive, if any.

44 Claims, 10 Drawing Sheets

VENTED CUTTING HEAD BODY FOR ABRASIVE JET SYSTEM

BACKGROUND

1. Technical Field

The present invention relates generally to abrasive jet systems and, in particular, to abrasive jet systems having a vented cutting head body.

2. Description of the Related Art

Conventional abrasive jet systems are used to process workpieces by pressurizing fluid and then delivering the pressurized fluid against a workpiece. Abrasive jet systems produce high-pressure abrasive fluid jets (commonly referred to as abrasive jets) suitable for cutting through hard materials. High-pressure fluid can flow through a jet-forming jewel orifice of a cutting head assembly to form a high-pressure fluid jet into which abrasive particles are entrained. The high-pressure abrasive fluid jet is discharged from the cutting head assembly towards the workpiece.

The abrasive and the fluid jet are often mixed together in a mixing chamber within the cutting head assembly. Abrasive delivered into the mixing chamber has a tendency to move upstream through the cutting head assembly towards the jewel orifice. This is because the upstream pressure (e.g., the pressure in a flow passageway between the mixing chamber and the jewel orifice) may be lower than the pressure in the mixing chamber. The pressure differential often leads to abrasive movement that may result in the abrasive striking and causing damage to a jewel orifice holder supporting the jewel orifice.

The abrasive may also eventually migrate upstream past the jewel orifice holder and ultimately to the top of the jewel orifice. Abrasive may slowly accumulate on the upstream surfaces of the jewel orifice. If some of the accumulated abrasive becomes dislodged, it may be picked-up by the high-pressure fluid that is forced through the jet-forming jewel orifice. The picked-up abrasive may quickly damage the jewel orifice, resulting in malfunctioning and/or significantly impaired performance of the cutting head assembly. The abrasive jet system has to be shut down to replace the damaged jewel orifice and clean abrasive from the cutting head assembly such that the waterjet cutting process can be performed once again. Unfortunately, the downtime may significantly reduce the productivity of the abrasive jet system.

BRIEF SUMMARY

An abrasive jet system, in some embodiments, has a nozzle assembly and a venting system for controlling the flow of media, such as abrasive, within the nozzle assembly. The venting system can protect various components of the nozzle system from the abrasive.

The venting system may include one or more vents for regulating the pressure within a cutting head body of the nozzle assembly to minimize, limit, or substantially eliminate media that reaches components of the nozzle assembly, such as an orifice mount, jewel orifice, and the like. The vents, in some embodiments, may include at least one venting port positioned between an orifice mount that retains a jewel orifice and a mixing region in which abrasive is mixed with a fluid jet produced by the jewel orifice. An isolator between the mixing region and orifice mount further protects the jewel orifice or other upstream components.

In some embodiments, an abrasive jet system having a nozzle assembly for producing an abrasive jet comprises a cutting head body that includes an orifice mount receiving section adapted to receive an orifice mount for retaining a jewel orifice, a mixing region positioned downstream of the orifice mount receiving section, an abrasive feed port through which abrasive moves into the mixing region, and a cutting head vent. The cutting head vent has a venting port and a venting through-hole extending outwardly from the venting port through a sidewall of the cutting head body. The venting port is positioned between the orifice mount receiving section and the mixing region such that the venting port is downstream of a fluid jet exit of an orifice mount in the orifice mount receiving section during use.

In some embodiments, an abrasive waterjet cutting head body comprises a mixing region, an abrasive feed port through which abrasive moves into the mixing region, a venting port positioned upstream of the abrasive feed port and downstream of an orifice mount seating face of the cutting head body such that the venting port is downstream of a fluid jet exit of an orifice mount seated against the orifice mount seating face. In some embodiments, a venting passageway extends from the venting port through a sidewall of the cutting head body.

In some embodiments, a method for producing an abrasive waterjet is provided. The method includes delivering a fluid jet produced by a jet generating orifice through an orifice mount towards a mixing region in the cutting head body. The abrasive is delivered through an abrasive feed port to the mixing region to entrain the abrasive in the fluid jet. The fluid is passed through a venting port positioned upstream of the mixing region and downstream of the orifice mount to adjust pressure in at least a portion of a passageway in the cutting head body extending between the orifice mount and the mixing region.

DETAILED DESCRIPTION

The following description relates to abrasive jet systems, assemblies, and subcomponents, for generating and delivering abrasive jets suitable for cleaning, abrading, cutting, milling, or otherwise processing workpieces. An abrasive jet system can have a nozzle assembly and a venting system for controlling the flow of abrasive within the nozzle assembly. The venting system can include, without limitation, one or more vents for regulating the pressure within at least a portion of the nozzle assembly to minimize, limit, or substantially eliminate physical interaction between the abrasive and an upstream component. The vents can be positioned between an orifice mount retaining a jewel orifice and an internal mixing region in which abrasive is mixed with a fluid jet. The vents, in some embodiments, can be used to increase or decrease the pressure upstream of a mixing region to protect a wide range of different components that are upstream of the mixing region.

Unless the context requires otherwise, throughout the specification and claims which follow, the word "comprise" and variations thereof, such as, "comprises" and "comprising" are to be construed in an open, inclusive sense, that is as "including, but not limited to."

Figure 1:
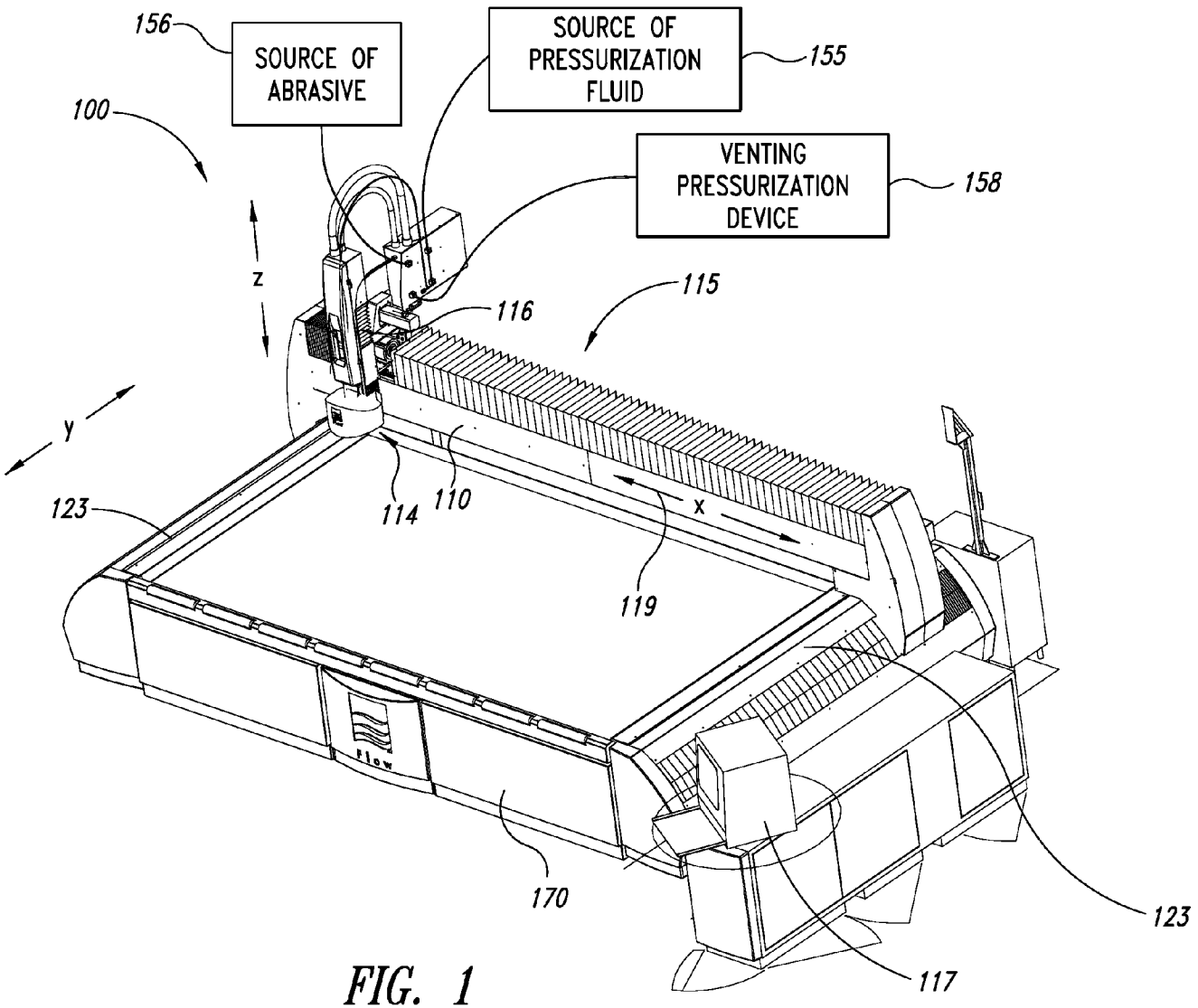
FIG. 1 is an isometric view of an abrasive jet system, in accordance with one illustrated embodiment.

FIG. 1 shows an abrasive jet assembly 100 for processing a wide range of workpieces. The abrasive jet system 100 includes an end effector assembly 114 moved using an actuation system 115. A control system 117 commands the actuation system 115 to control the path of travel of the end effector assembly 114, capable of generating and delivering a downwardly directed fluid jet (e.g., a waterjet, abrasive jet, and the like) suitable for cleaning, abrading, cutting, milling, or otherwise processing workpieces.

The actuation system 115 of FIG. 1 includes a ram 116 for motion along a vertical Z-axis. The ram 116 is slidably coupled to a bridge 110 for motion along an X-axis that is generally parallel to a longitudinal axis 119 (shown corresponding to the X-axis) of the bridge 110. The bridge 110 is mounted on one or more rails 123 to allow the bridge 110 to move in a direction perpendicular to its longitudinal axis 119. The illustrated bridge 110 can move along a Y-axis that is generally perpendicular to the X-axis. The end effector assembly 114 can be moved along the X-axis, Y-axis, and/or Z-axis using the actuation system 115.

Other types of positioning systems employing one or more linear slides, rail systems, carriages, motors, and the like can be used to selectively move the end effector assembly 114 as needed or desired. U.S. Pat. No. 6,000,308 and U.S. Publication No. 2003/0037650 (application Ser. No. 09/940,689), which are both herein incorporated by reference in their entireties, disclose systems, assemblies, components, and mechanisms that can be used to move, control, and/or operate the end effector assembly 114.

The control system 117 may generally include, without limitation, one or more computing devices, such as controllers, processors, microprocessors, digital signal processors (DSP), application-specific integrated circuits (ASIC), and the like. To store information, the control system 117 may also include one or more storage devices, such as volatile memory, non-volatile memory, read-only memory (ROM), random access memory (RAM), and the like. The storage devices can be coupled to the computing devices by one or more busses. The control system 117 of FIG. 1 may further include one or more input devices (e.g., a display, keyboard, touchpad, controller module, or any other peripheral device for user input).

The end effector assembly 114 is coupled to a source of pressurized fluid 155, a source of abrasive 156, and a venting pressurization device 158. Pressurized fluid, such as water, from the source of pressurized fluid 155 and abrasive from the source of abrasive 156 are combined together in the end effector assembly 114 to generate an abrasive jet comprising both abrasive (or other media) and the fluid. The venting pressurization device 158 can actively vent the end effector assembly 114 by providing a venting fluid (e.g., air) to control the flow of abrasive within the end effector assembly 114 to, for example, improve performance, increase the working life of one or more components of the end effector assembly 114, adjust entrainment of the abrasive, and the like.

The source of abrasive 156 can contain various types of abrasive that are ultimately entrained in the fluid jet. Although many different types of abrasive may be used, some embodiments use particles on the order of about 220 mesh or finer. The particular size can be selected based on the rate of abrasion and the desired surface textures (e.g., surface smoothness). Exemplary abrasive includes garnet particles, silica sand, glass particles, combinations thereof, and the like. The characteristics of abrasive can be selected based on whether the fluid jet abrades, texturizes, cuts, etches, polishes, cleans, or performs another procedure. Other types of media, even non-abrasive media, can also be contained in and outputted by the source 156, if needed or desired.

The venting pressurization device 158 of FIG. 1 may be a gas (e.g., air, nitrogen, and the like) compressor, such as a pump with a fixed or variable displacement, that causes the pressure of the gas delivered to the end effector assembly 114 to be greater than the ambient air pressure and/or the temperature of the gas to be greater than the ambient temperature. In some embodiments, the venting pressurization device 158 is an electric pump capable of compressing a gas to a pressure of at least 50 psi (0.34 MPa). Alternatively, the venting pressurization device 158 may be a fan or blower driven by one or more motors. In some embodiments, the venting pressurization device 158 includes a vacuum device for drawing a vacuum such that a pressure within a portion of the end effector assembly 114 is less than the ambient air pressure. Additionally or alternatively, the venting pressurization device 158 can include one or more heating devices. In some embodiments, the pressurization device 158 is in the form of a resistive heating device capable of heating the gas a desired amount. The heated gas can be delivered into the end effector assembly 114.

The abrasive jet is discharged from the end effector assembly 114 towards a workpiece positioned on a table/catcher tank 170 and is manipulated along a selected path, using selected operating parameters, to process the workpiece to achieve a desired end product. The control system 117 may be used to control the source of pressurized fluid 155, the source of abrasive 156, and/or the venting pressurization device 158 to produce types of abrasive jets with desired characteristics.

Figure 2:
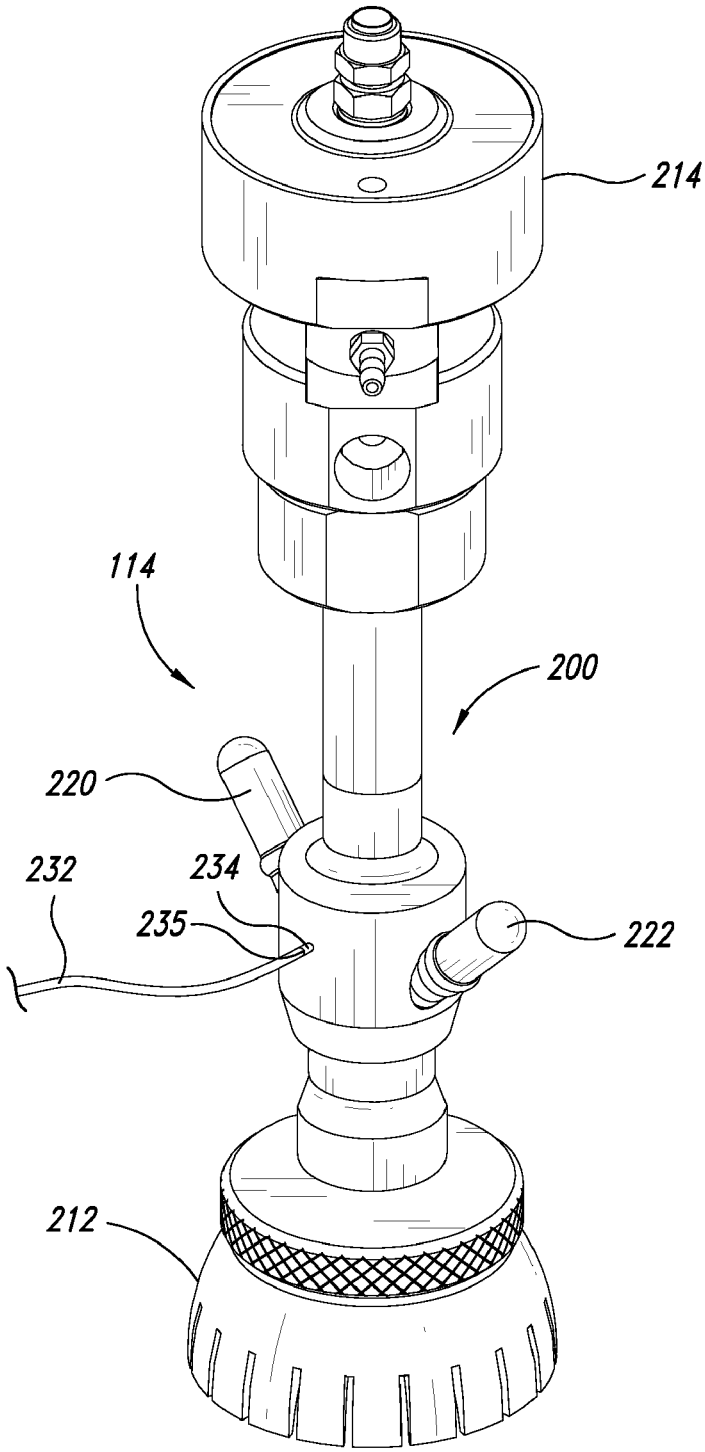
FIG. 2 is an isometric view of an end effector assembly, in accordance with one illustrated embodiment.

Referring to FIG. 2, the end effector assembly 114 includes a valve assembly 214 and a nozzle assembly 200. In some embodiments, if desired, the end effector assembly 114 may also include an annular shield or skirt 212 that is temporarily or permanently coupled to the nozzle assembly 200. The nozzle assembly 200 can be for ultrahigh pressures, medium pressures, low pressures, or combinations thereof. Ultrahigh pressure cutting head assemblies can operate at pressures equal to or greater than about 80,000 psi (551 MPa). High-pressure cutting head assemblies can operate at a pressure in the range of about 50,000 psi (345 MPa) to about 90,000 psi (621 MPa). Medium-pressure cutting head assemblies can operate at a pressure in the range of about 15,000 psi (103 MPa) to about 50,000 psi (345 MPa). Low-pressure cutting head assemblies can operate at a pressure in the range of about 10,000 psi (69 MPa) to about 40,000 psi (276 MPa).

The components of cutting head assemblies, such as mixing tubes, jewel orifices, and orifice mounts can be selected based on the operating parameters, such as working pressures, cutting action, and the like. The valve assembly 214 selectively controls the flow of pressurized fluid into the nozzle assembly 200. U.S. Publication No. 2003/0037650, incorporated by reference herein, discloses various types of valve assemblies that can be used with the illustrated nozzle assembly 200. Other types of valve assemblies can also be used with the nozzle assembly 200, if needed or desired.

Pressurized fluid from the source of fluid 155 can pass downwardly through the valve assembly 214 and into the nozzle assembly 200. Within the nozzle assembly 200, abrasives from the abrasive source 156 are delivered into the nozzle assembly 200 via an abrasive port 222. The illustrated nozzle assembly 200 also includes an auxiliary port 220 used to control operation of the end effector assembly 114. The port 220, for example, can allow the introduction of a second substance or allow the nozzle assembly 200 to be connected to a pressurization source (e.g., a vacuum source, pump, and the like) or one or more sensors (e.g., pressure sensors). U.S. Publication No. 2003/0037650 and U.S. Pat. Nos. 6,875,084 and 5,643,058 disclose methods and devices that can be used with the ports 220, 223. U.S. Publication No. 2003/0037650 and U.S. Pat. Nos. 6,875,084 and 5,643,058 are incorporated by reference herein in their entireties.

A venting line 232 provides communication between the nozzle assembly 200 and the venting pressurization device 158. A venting fluid from the venting pressurization device 158 may pass through the venting line 232 and into the nozzle assembly 200. The venting line 232, in some embodiments, is in the form of one or more hoses, conduits, tubes, pipes, or other suitable components that can define fluid pathways. In some embodiments, the venting line 232 is a flexible hose extending between the nozzle assembly 200 and the venting pressurization device 158. A protruding line connector 234 of the nozzle assembly 200 is coupled to a downstream end 235 of the venting line 232.

In other embodiments, the pressurization device 158 can be coupled directly to the exterior of the nozzle assembly 200. For example, the pressurization device 158 can be physically mounted to the nozzle assembly 200 by a plurality of fasteners, welds, or the like. Various types of connectors or brackets can be used to couple the pressurization device 158 to the nozzle assembly 200. The nozzle assembly 200 can thus carry the pressurization device 158 during processing.

Figure 3:
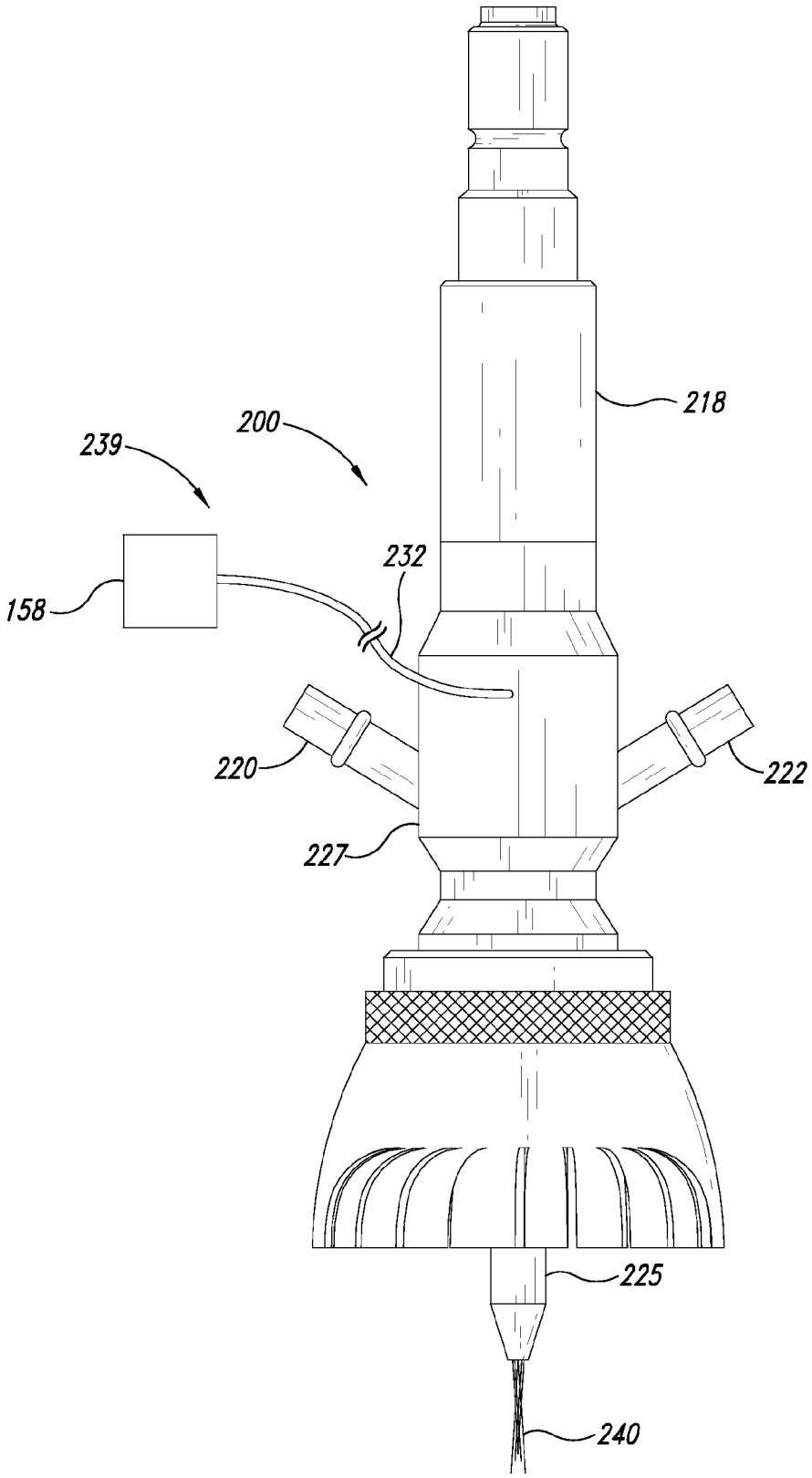
FIG. 3 is a side elevational view of a nozzle assembly in communication with a venting pressurization device, in accordance with one illustrated embodiment.
Figure 4:
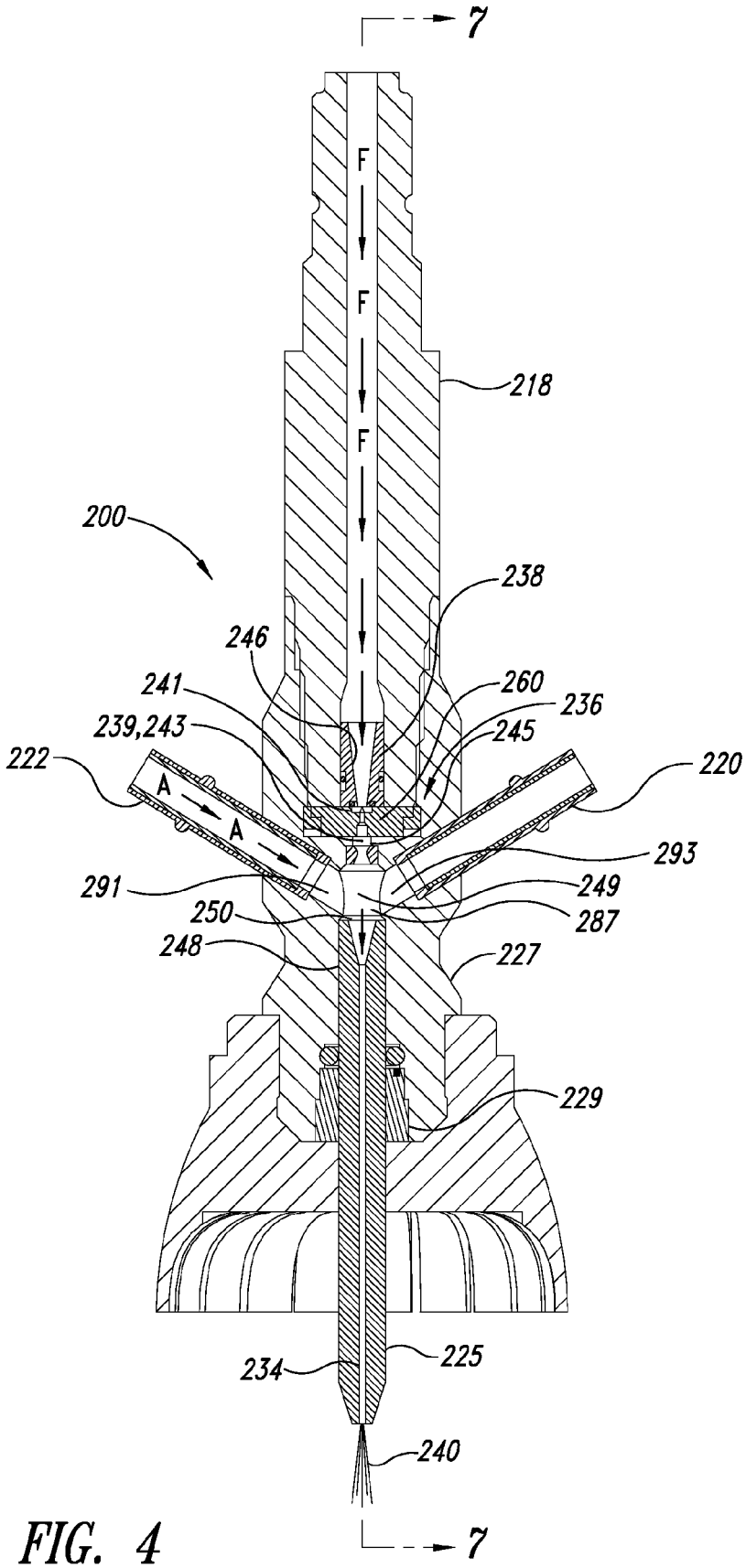
FIG. 4 is a cross-sectional view of a nozzle assembly having a vented cutting head body, in accordance with one illustrated embodiment.

FIG. 3 illustrates a venting system 239 including the venting pressurization device 158, the venting line 232, and a vented cutting head body 227 of the nozzle assembly 200. The nozzle assembly 200 includes a feed conduit 218, the cutting head body 227, and a mixing tube 225 releasably coupled to the cutting head body 227 via a retainer 229 (FIG. 4). The mixing tube 225 extends along the length of the shield 212. A jet generating assembly 236 of FIG. 4 for generating a fluid jet includes an orifice mount 260 and a jewel orifice 241 and, in some embodiments, a seal assembly 238. The illustrated jet generating assembly 236 produces a high-pressure fluid jet from the feed fluid F flowing through the feed conduit 218.

In some embodiments, the seal assembly 238 has a passageway 246 that tapers inwardly in the downstream direction so as to direct the fluid F into and through the jewel orifice 241. The jewel orifice 241 produces a fluid jet in which abrasive A, flowing through the abrasive port 222, is entrained at a mixing region 249, illustrated as a mixing chamber. Various types of jewel orifices or other fluid jet producing devices can be used to achieve the desired flow characteristics of a fluid jet.

The orifice mount 260 is fixed with respect to the cutting head body 227 and includes a recess (e.g., a disk-shaped recess) dimensioned to receive and to hold the jewel orifice 241. The jewel orifice 241 is kept in proper alignment with respect to the passageway 246 of the seal assembly 238 and the mixing tube 225. The configuration and size of the orifice mount 260 can be selected based on the desired position of the jewel orifice 241. The illustrated orifice mount 260 is disk-shaped and is removably retained by the cutting head body 227. If the orifice mount 260 becomes worn, it can be replaced without damaging the cutting head body 227 or altering the venting functionality of the cutting head body 227.

A vent 239 includes a venting port 243 positioned between the orifice mount 260 and the mixing region 249. The venting port 243 can be in the form of one or more apertures, openings, inlets, and the like. Fluid from the venting line 232 can flow through the venting port 243 into or out of a venting region 245, illustrated as a venting chamber, to control movement of the abrasive A within the cutting head body 227. In some embodiments, the pressure in the venting chamber 245 can be sufficiently high to minimize, limit, or substantially prevent the movement of the abrasive A through the venting chamber 245. A wide range of desired pressure differentials can be maintained between the mixing region 249 and the venting chamber 245 using the vent 239, as detailed below.

In some embodiments, the venting port 243 has a diameter that is equal to or less than about 0.03 inches, about 0.02 inches, or about 0.01 inches, or ranges encompassing such dimensions. In some embodiments, for example, the venting port 243 having a diameter equal to or less than about 0.03 inches can be used to deliver air at a pressure in the range of about 0 psi to about 30 psi (0.2 MPa) such that the pressurized venting chamber 245 serves as an effective abrasive barrier without appreciably effecting the vacuum in the mixing region 249. The dimensions, position, and configuration of the venting port 243 can be selected to maintain a vacuum (or desired positive pressure) in the mixing region 249 for proper abrasive entrainment. Different working pressures in the mixing region 249 can be utilized to adjust performance of the waterjet assembly 100 as discussed in detail below.

Figure 5:
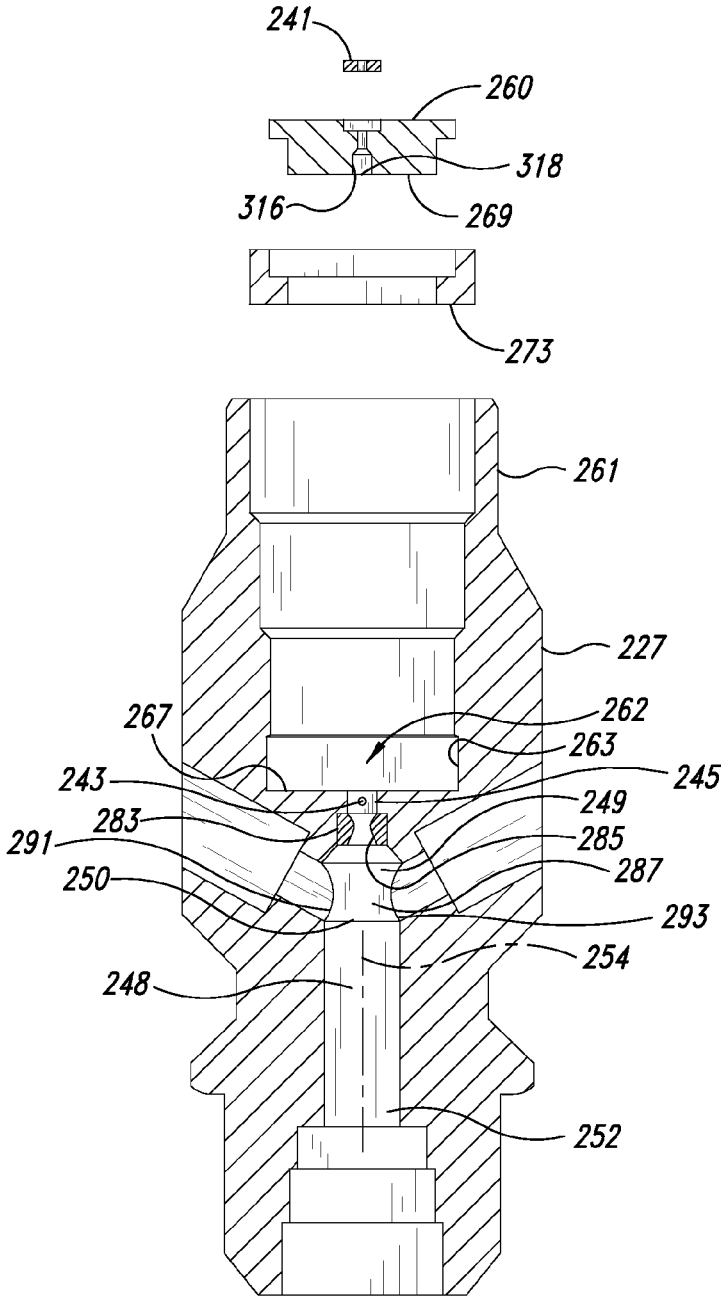
FIG. 5 is an exploded, cross-sectional view of some components of a nozzle assembly, in accordance with one illustrated embodiment.

Referring to FIG. 5, the cutting head body 227 has a one-piece construction formed via a machining process, injection molding process (e.g., an injection molding process), and the like. The cutting head body 227 can be made, in whole or in part, of one or more metals (e.g., steel, aluminum, titanium, etc.), metal alloys, and the like. Because the cutting head body 227 has a reliable one-piece construction, it is not prone to malfunction. Therefore, even though other components of the nozzle assembly 200 may be frequently replaced, the cutting head body 227 has a relatively long working life with consistent, reliable operation.

The cutting head body 227 of FIG. 5 includes a sidewall 261 that defines an orifice mount receiving section 262, the venting chamber 245, the mixing region 249, and the bore 248 for receiving the mixing tube 225. (FIG. 5 shows the cutting head body 227 with the mixing tube 225 removed.) The receiving section 262 is adapted to receive and support the orifice mount 260. When the orifice mount 260 is seated against a support surface 267 of the receiving section 262, the venting port 243 is spaced apart from a lower surface 269 of the orifice mount 260 (shown separated from the cutting head body 227). When assembled, the lower surface 269 of the orifice mount 260 can bear against the support surface 267 of the cutting head body 227.

The receiving section 262 includes a generally cylindrical sidewall 263 extending from the support surface 267. The sidewall 263 can closely surround the orifice mount 260 to limit side-to-side movement of the jewel orifice 241. A seating member 273 can facilitate seating of the orifice mount 260. The seating member 273 can be an annular member, an O-ring, or other type of component suitable for maintaining the proper position of the orifice mount 260 with respect to the receiving section 262.

Figure 6:
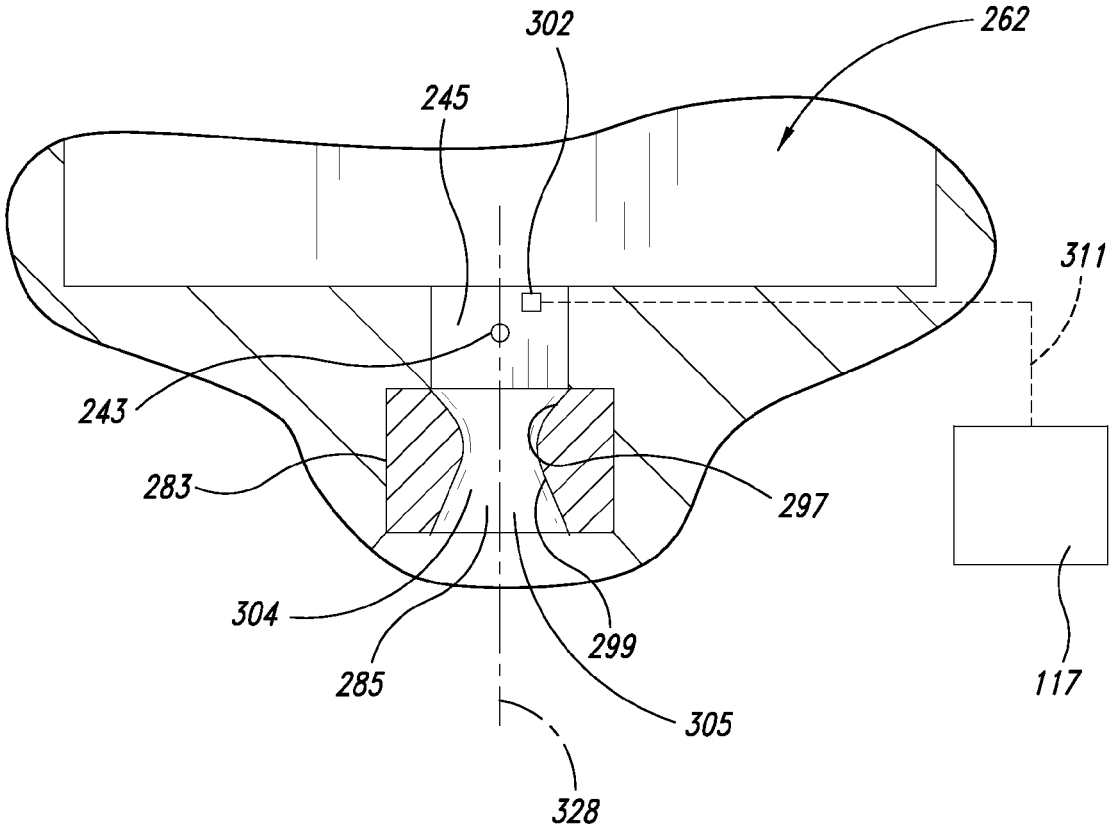
FIG. 6 is a detailed cross-sectional view of a portion of a cutting head body having a vent and a removable isolator, in accordance with one illustrated embodiment.

Referring to FIG. 5, a removable isolator 283 is positioned between the venting chamber 245 and the mixing region 249. The isolator 283 of FIG. 6 is a convergent-divergent flow device that includes an upstream converging section 297 and a downstream diverging section 299. In some embodiments, including the illustrated embodiment of FIG. 6, the isolator 283 has a through-hole 285 sized to closely surround the fluid jet passing therethrough so as to physically obstruct or impede the flow of abrasive in the upstream direction. The isolator 283 can thus inhibit upstream flow of the abrasive A, if any, into the venting chamber 245 while the through-hole 285 allows a desired amount of spreading of the fluid jet before the abrasive entrainment. In some embodiments, the isolator can create an accelerated flow around the fluid jet. For example, the isolator 283 can create a high speed flow (e.g., a supersonic flow) about the fluid jet. This flow can further prevent upstream migration of the abrasive.

The isolator 283 can be removably coupled to the cutting head body 227. External threads of the isolator 283 can mate with internal threads of the cutting head body 227. The isolator 283 can be rotated to remove it from the cutting head body 227. In other embodiments, the isolator 283 is permanently coupled to the cutting head body 227 via one or more welds. In other embodiments, the isolator 283 can be integrally formed with the cutting head body 227.

Various materials can be used to form the isolator 283. In some embodiments, for example, the isolator 283 can be made, in whole or in part, of a hardened, wear-resistant material. This type of material is especially well suited for reducing wear to increase the service life of the isolator 283. In such embodiments, the isolator 283 can be repeatedly exposed to the fluid jet exiting the orifice mount 260. The hardened, wear-resistant material may be harder than the material forming the cutting head body 227. Accordingly, the isolator 283, for example, can erode less than the cutting head body 227 when both the isolator 283 and the cutting head body 227 are contacted by the fluid jet.

Hardened, wear-resistant materials may include, without limitation, tungsten carbide, titanium carbide, alumina, and other abrasion resistant materials that can withstand exposure to the fluid jets disclosed herein. Various types of testing methods (e.g., the Rockwell hardness test or Brinell hardness test) can be used to determine material hardness.

Referring again to FIGS. 4 and 5, an inner surface 287 of the cutting head body 227 defines the mixing region 249, an abrasive inlet 291 of the abrasive port 222, and an auxiliary inlet 293 of the auxiliary port 220. Abrasive passing through the inlet 291 is entrained in the fluid jet passing through the mixing region 249. Entraining can include, without limitation, mixing, combining, or otherwise bringing together two or more different substances. For example, the abrasives A can be partially or fully mixed with the fluid forming the fluid jet such that the fluid jet carries the abrasives A into and through the mixing tube 225, thereby forming an abrasive jet. As used herein, the term "abrasive jet" generally refers to, but is not limited to, a fluid jet carrying abrasive.

The bore 248 of FIG. 5 includes an entrance 250 positioned opposite the isolator 283, an exit 252 opposite the entrance 250, and a longitudinal axis 254 extending therebetween. In some embodiments, the entrance 250 is proximate to the location of abrasive entrainment to facilitate entry of the abrasive jet into the mixing tube 225.

With reference to FIG. 6, a sensor 302 can be operated to evaluate performance of the nozzle assembly 200. The sensor 302 can be a pressure sensor capable of outputting at least one signal indicative of the pressure in a passageway 304 extending between the receiving section 263 and the mixing tube 225. The sensor 302 of FIG. 6 is positioned in or connected to the venting chamber 245 and measures the pressure proximate to a fluid jet flow path 328 along the passageway 304. As the fluid jet passes along the flow path 328, the sensor 302 can continuously or intermittently measure the pressure in the venting chamber 245. Sensors can also be at any number of other locations along the cutting head body 227.

The term "pressure sensor" includes, but is not limited to, a sensor that detects an absolute pressure or a pressure differential, or both. Exemplary pressure sensors include, without limitation, absolute pressure sensors, differential pressure sensors, gauge pressure sensors, pressure transducers, and the like. The illustrated sensor 302 is a pressure sensor capable of sending one or more signals to the control system 117 (illustrated schematically in FIG. 6) via a line 311 (shown in phantom line). In other embodiments, the sensor 302 communicates wirelessly with the control system 117.

Based on one or more signals from the sensor 302, the control system 117 can adjust one or more processing parameters (e.g., operating pressures, flow rates of the working fluid or abrasive, flow rate of a venting fluid, and the like). For example, if the pressure in the venting chamber 245 is below a desired pressure, the control system 117 commands the venting pressurization device 158 to increase the pressure in the venting chamber 245. The control system 117 can also shut off the jet, for example, during non-processing stages (e.g., between processing workpieces), to perform maintenance, to replace components of the abrasive jet system 100, and the like.

Figure 7:
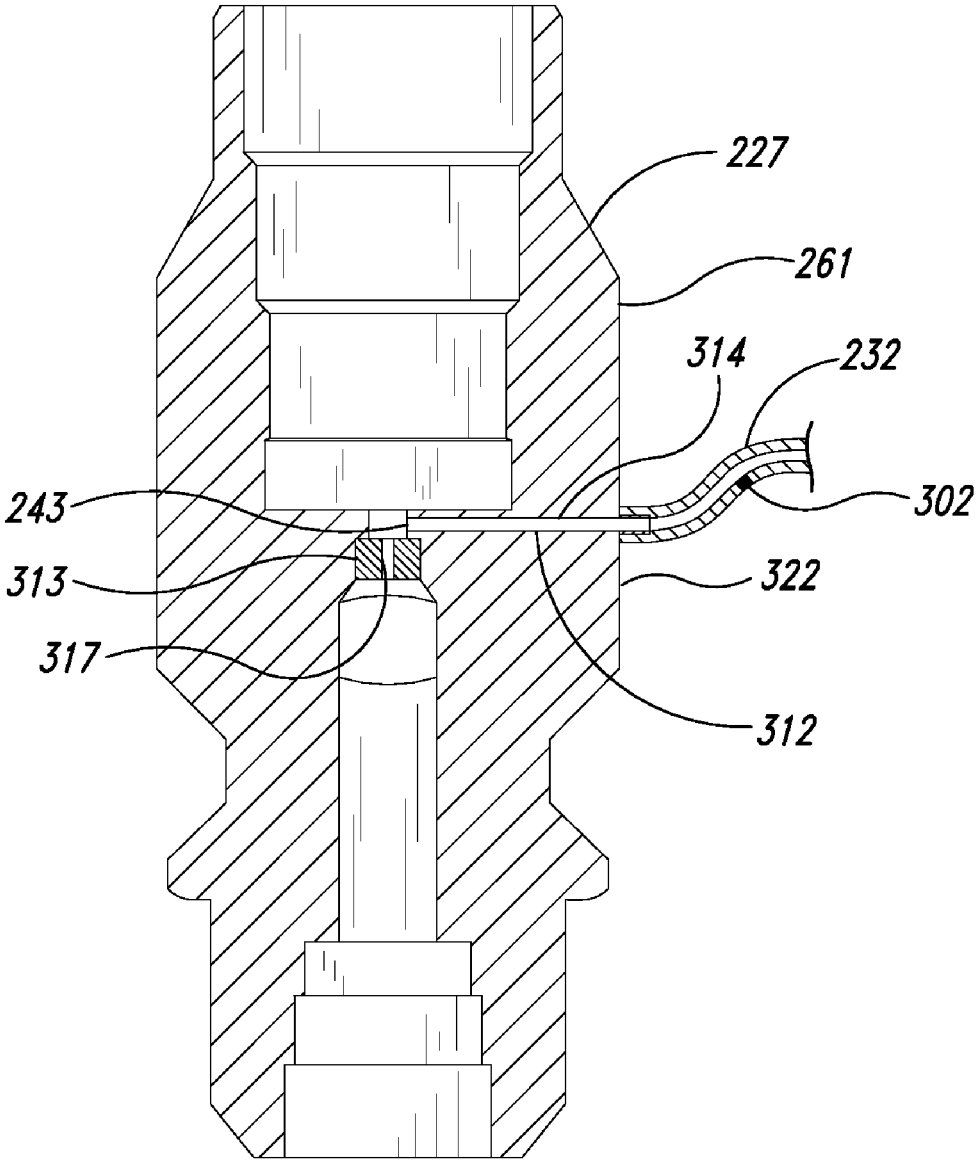
FIG. 7 is a cross-sectional view of a vented cutting head body taken along line 7-7 of FIG. 4.

Referring to FIG. 7, the cutting head body 227 includes the sidewall 261 defining a venting through-hole 312 extending outwardly from the venting port 243, which is positioned upstream of an isolator 313 with a through-hole 317 having, in one embodiment, a generally uniform diameter along the longitudinal length of through-hole 317. A tubular surface 314 of the cutting head body 227 defines the venting through-hole 312 and extends continuously and uninterruptedly from the venting port 243 to an exterior surface 322 of the cutting head body 227. The illustrated venting through-hole 312 has a generally straight configuration. In other embodiments, the venting through-hole 312 can have a curved configuration or angled configuration.

In some methods of operation, fluid F from the source of pressurized fluid 155 is delivered through the valve assembly 214 along the feed conduit 218 of the nozzle assembly 200 of FIG. 4. The fluid F is then delivered to the jet generating assembly 236. The jewel orifice 241 produces a fluid jet that passes through a central passageway 316 of the orifice mount 260 (see FIG. 5). The fluid jet exits a fluid jet exit 318 of the orifice mount 260, enters the venting chamber 245, and proceeds through the isolator 283 into the mixing region 249.

To form the abrasive jet, the abrasive A from the source of abrasive 156 is delivered through the abrasive port 222 and into the mixing region 249 via the abrasive inlet 291. The fluid jet and abrasive A are combined together and delivered through a channel 234 of the mixing tube 225 of FIG. 4. The abrasive A and fluid F can be further mixed in the mixing tube 225 to produce a desired abrasive jet 240 exiting the mixing tube 225.

The venting pressurization device 158 outputs venting fluid that passes through the venting port 243 and into the venting chamber 245. The venting pressurization device 158 can keep the venting chamber 245 at a desired pressure (e.g., below atmospheric pressure, equal to atmospheric pressure, above atmospheric pressure, or combinations thereof. The pressure in the venting chamber 245 can be selected based on the desired pressure differential between the venting chamber 245 and the mixing region 249. The pressure of the venting chamber 245 can be below atmospheric pressure to increase spreading of the jet. The pressure of the venting chamber 245 can be generally at atmospheric pressure to avoid pressure changes due to improper operation of pressurization devices, such as mechanical pumps. For example, ambient air can flow through the cutting head body 227 and into the venting chamber 245 to keep the venting chamber 245 at approximately atmospheric pressure. The pressure of the venting chamber 245 can be greater than atmospheric pressure to enhance jet coherency. During processing, the pressure of the venting chamber 245 may be at different pressures based on the desired properties of the jet. The sensor 302 of FIG. 7 positioned along the venting line 232 is used to evaluate the venting pressures, if needed or desired. As such, the pressure of the venting chamber 245 can be accurately controlled to achieve a constant or varying pressure.

The flow rate of the venting fluid can be increased or decreased to increase or decrease the pressure in the venting chamber 245. A sufficient amount of venting fluid can be passed through the venting port 243 to keep the venting chamber pressure at or above the pressure in the mixing region 249. For example, the venting chamber 245 can be maintained at or above a first pressure, and the mixing region 249 can be maintained at or below a second pressure, which is less than the first pressure. In some embodiments, for example, a vacuum is maintained in the mixing region 249. The first pressure can be at least 0.05 psi (0.3 MPa) greater than the second pressure. This pressure differential may be maintained to inhibit, limit, or substantially prevent the abrasives A from migrating into and/or through the venting chamber 245. The venting fluid and the fluid jet can flow through the isolator 283 and into the mixing region 249, thereby further inhibiting upstream flow of the abrasive A.

Figure 8A:
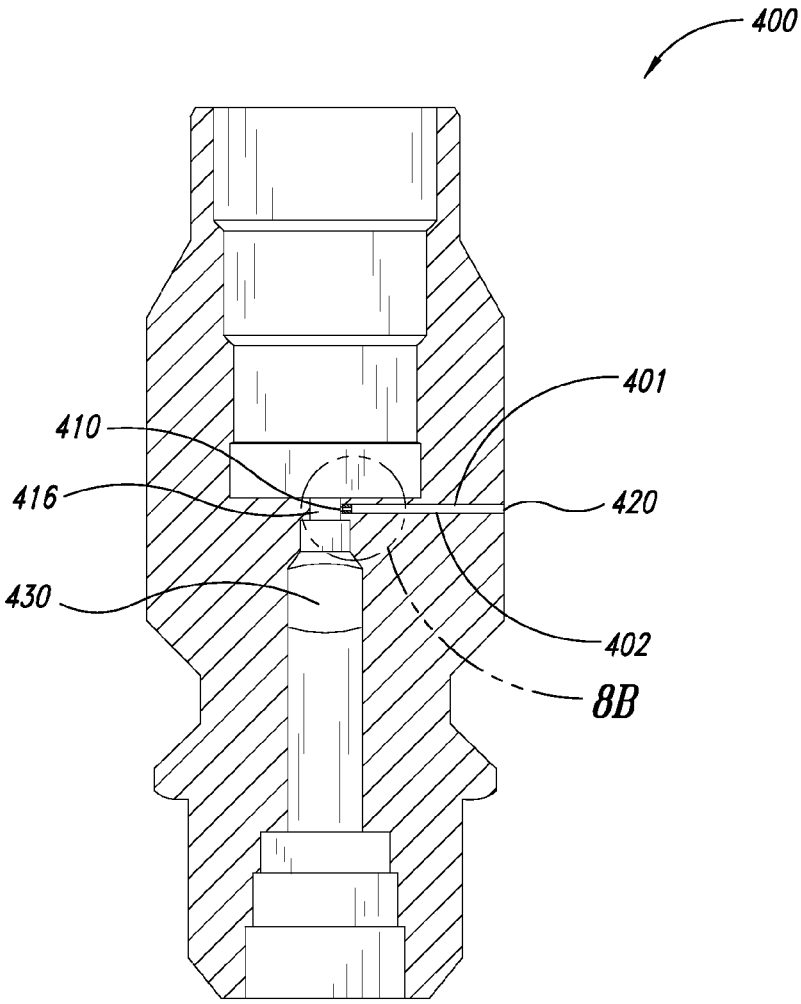
FIG. 8A is a cross-sectional view of a vented cutting head body for venting ambient air, in accordance with one illustrated embodiment.

Vents can also provide passive venting by, for example, establishing fluid communication between the ambient external air and the interior of a cutting head body. FIG. 8A, for example, shows a cutting head body 400 that includes a passive vent 401 having a venting through-hole 402 with a first end 410 for communicating with a venting chamber 416 and a second end 420 for communicating with external ambient air. The pressure in the cutting head body 400 can be at a relatively low pressure (e.g., below atmospheric pressure) due to the vacuum effect of the high speed flow of the fluid jet. The low pressure causes ambient air to be drawn through the second end 420 and into the vent through-hole 402. The air is then drawn into the venting chamber 416, resulting in a relatively high venting chamber pressure as compared to the pressure in a mixing region 430.

Figure 8B:
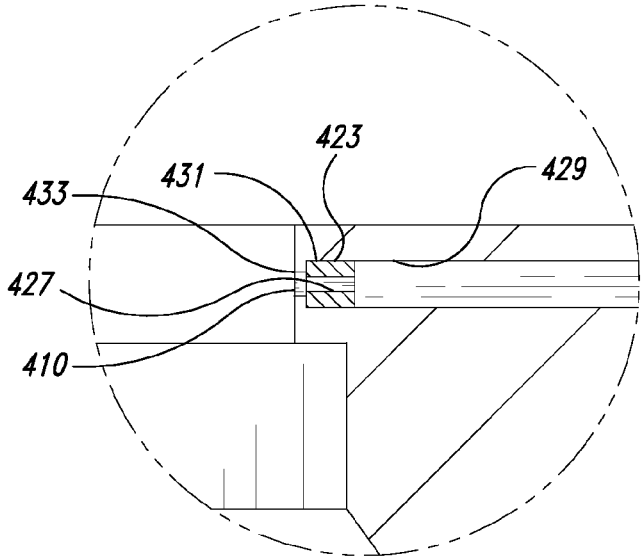
FIG. 8B is a detailed view of a portion of the cutting head body of FIG. 8A.

The passive vent 401 can include one or more orifice members to control the flow of fluid into the venting chamber 416. As shown in FIGS. 8A and 8B, a flow regulating orifice member 423 is positioned along the passive vent 401 and has a through-hole 427 through which ambient air flows. The diameter of the through-hole 427 can be increased or decreased to increase or decrease the flow rate of air passing through the orifice member 423 and ultimately into the venting chamber 416. Additionally, the through-hole 427 can have a generally uniform diameter, illustrated in FIG. 8B, or a varying diameter along its longitudinal length.

The orifice 423 can be permanently or temporarily coupled to the cutting head body 400. In some embodiments, the orifice member 423 has an outer surface 431 with external threads that mate with internal threads along an inner surface 429 of the passive vent 401. In some embodiments, the orifice member 423 is permanently coupled to the inner surface 429 via one or more adhesives or welds. The illustrated cutting head body 400 includes a stop 433 that prevents movement of the orifice member 423 towards the venting chamber 416. The orifice member 423 can be replaced with another orifice member based on the waterjet orifice size. Example orifice members include, without limitation, metering orifices, regulating orifices, and the like. Regulating orifices can be in the form of valves for actively adjusting fluid flow rates. The illustrated orifice member 423 is a type of orifice without movable components for producing desired fluid flow rates.

The orifice member 423 can be made, in whole or in part, of a hardened material, such as a wear resistant material, to resist wear that may lead to appreciable dimensional changes. If a highly-pressurized fluid flows through the passive vent 401, the orifice member 423 can be in the form of a jewel. Other types of materials can also be used to make the orifice.

Figure 9:
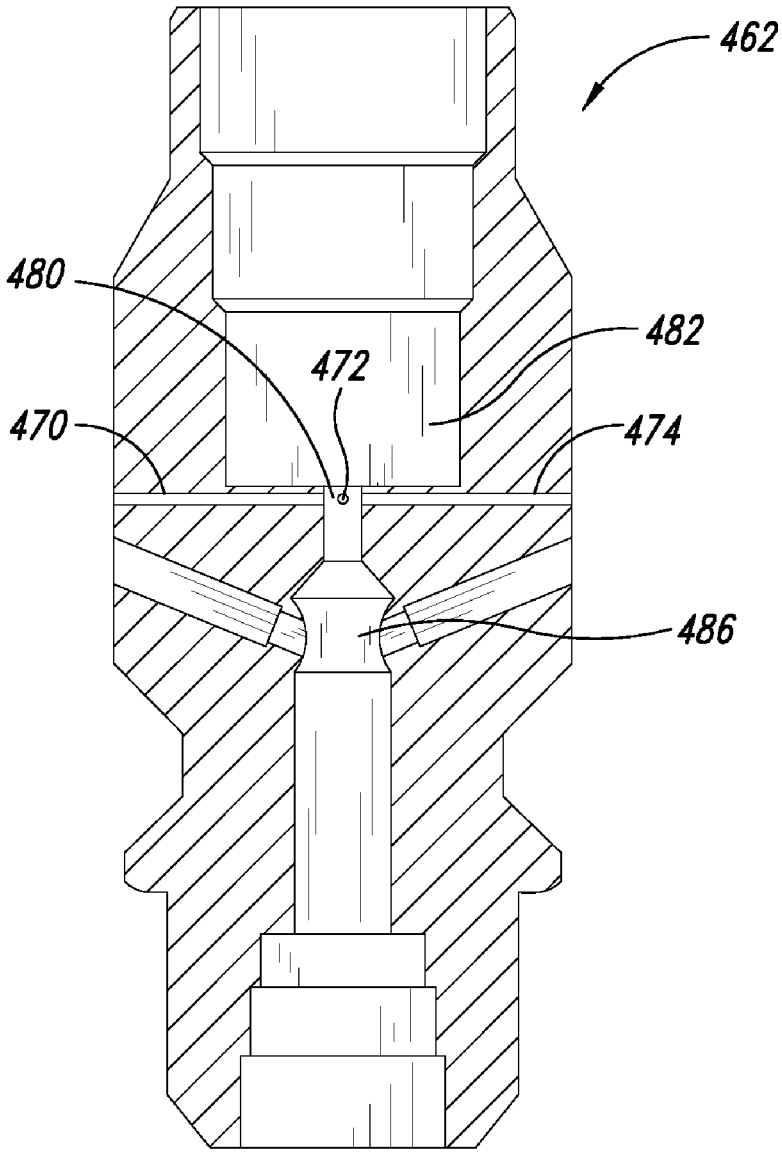
FIG. 9 is a cross-sectional view of a vented cutting head body including a plurality of vents, in accordance with one illustrated embodiment.

A cutting head body can include a plurality of vents. An illustrated cutting head body 462 of FIG. 9 includes a plurality of vents 470, 472, 474. The vents 470, 472, 474 can be used with a venting pressurization device, such as the venting pressurization device 158 discussed in connection with FIG. 1, or with atmospheric air, as discussed in connection with FIG. 8A. By way of example, the vent 470 may provide communication between a venting chamber 480 and the external environment, while the vent 472 may provide communication between a venting pressurization device and the venting chamber 480. The illustrated venting chamber 480 is a generally cylindrical passageway extending between an orifice mount receiving section 482 and a mixing region 486. An isolator can be positioned between the venting chamber 480 and the mixing region 486 to further inhibit upstream movement of the abrasives in the mixing region 486, if needed or desired.

Figure 10:
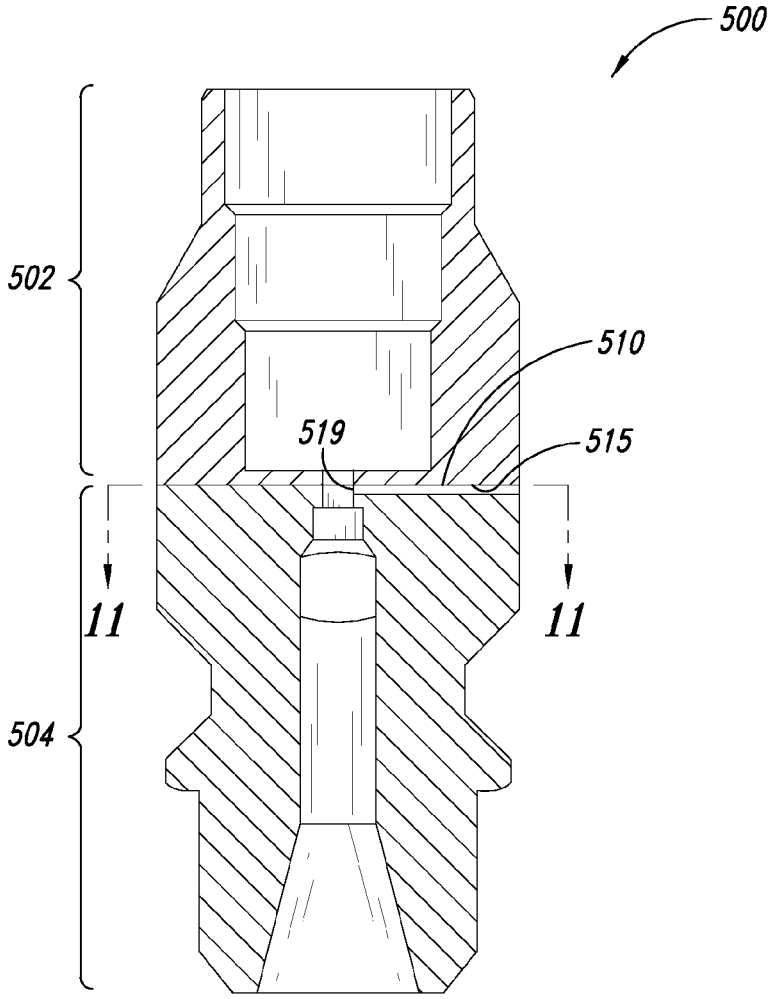
FIG. 10 is a cross-sectional view of a multi-piece cutting head body, in accordance with one illustrated embodiment.

Various types of manufacturing techniques can be used to form the vents discussed herein. For example, the vents of FIGS. 2-8B can be formed by drilling a hole through the cutting head body. In other embodiments, the vent can be formed during the manufacturing of the cutting head body. For example, a cutting head body with a vent can be formed using an injection molding process. Thus, a single manufacturing process can form a unitary vented cutting head body. Alternatively, the cutting head body can have a multi-piece construction. FIG. 10 illustrates a cutting head body 500 that includes an upstream section 502 and a downstream section 504. Vents 510 are formed in the upstream section 502, the downstream section 504, or both.

The illustrated vent 510 is formed by the upstream section 502 and the downstream section 504. The vent 510 extends radially outward from a center bore 519 of the cutting head body 500 and is formed, at least in part, by the downstream section 504. For example, vent 510 can be formed, at least in part, by a groove 511 (see FIG. 11) extending generally along an upper surface 513 of the downstream section 504 and a lower surface 515 of the upstream section 502. The groove 511 can have a U-shaped cross-section, V-shaped cross-section, semi-circular cross-section, or any other suitable shape. Various types of milling or other machining techniques can be used to form the groove 511.

Figure 11:
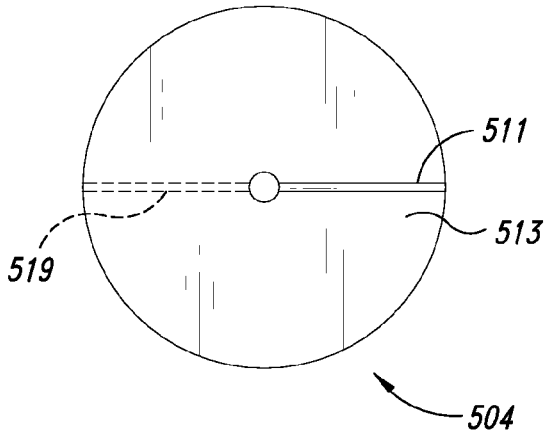
FIG. 11 is a cross-sectional view of the cutting head body of FIG. 10 taken along line 11-11.

To access the vent 510, the upstream section 502 can be conveniently separated from the downstream section 504. If an orifice member is positioned along the vent 510, the vent 510 can be accessed to inspect, replace, and/or reposition the orifice member. Any number of radially extending grooves can be provided to achieve the desired venting. FIG. 11 shows an additional groove 519 in a broken line.

The upstream and downstream sections 502, 504 can be permanently coupled together via one or more welds or permanent fasteners. Alternatively, the upstream and downstream sections 502, 504 can be removably coupled together via one or more couplers, fasteners (e.g., bolts), and the like.

Various methods and techniques described above provide a number of ways to carry out the disclosed embodiments. Furthermore, one of ordinary skill in the art will recognize the interchangeability of various features, such as mixing chambers, vents, and mixing tubes, from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. An abrasive jet system having a nozzle assembly for producing an abrasive jet, the abrasive jet system comprising:

a cutting head body of the nozzle assembly including an orifice mount receiving section adapted to receive an orifice mount for retaining a jewel orifice, a mixing region positioned downstream of the orifice mount receiving section, an abrasive feed port through which abrasive moves into the mixing region, and a cutting head vent having a venting port and a venting through-hole extending outwardly from the venting port through a sidewall of the cutting head body, the venting port positioned between the orifice mount receiving section and the mixing region such that the venting port is downstream of a fluid jet exit of an orifice mount in the orifice mount receiving section during use; and an isolator mounted in the cutting head body and positioned between the venting port and the mixing region.

2. The abrasive jet system of claim 1, further comprising:

a venting pressurization device in communication with the cutting head vent, the venting pressurization device adapted to deliver fluid through the venting through-hole and the venting port as abrasive passes through the abrasive feed port and is mixed with a fluid jet produced by a jewel orifice held by an orifice mount in the orifice mount receiving section.

3. The abrasive jet system of claim 2, wherein the venting pressurization device is a pump capable of sufficiently pressurizing the fluid so as to keep a pressure in a passageway between the orifice mount receiving section and the mixing region above a pressure in the mixing region as the abrasive is mixed with the fluid jet.

4. The abrasive jet system of claim 1, wherein the venting through-hole provides fluid communication between the venting port and an ambient environment external to the cutting head body such that atmospheric air external to the cutting head body is drawn through the venting through-hole and the vent port as a fluid jet passes through the mixing region.

5. The abrasive jet system of claim 4, further comprising:

a flow regulating orifice member positioned in the venting through-hole.

6. The abrasive jet system of claim 1, further comprising:

an orifice mount seated in the orifice mount receiving section, the orifice mount having a fluid jet exit positioned upstream of the venting port.

7. The abrasive jet system of claim 1, further comprising:

an orifice mount in the orifice mount receiving section, the entire orifice mount spaced apart from the venting port along a longitudinally-extending fluid jet flow path.

8. The abrasive jet system of claim 1, wherein the venting port has a diameter that is equal to or less than about 0.03 inch.

9. The abrasive jet system of claim 1, wherein the venting through-hole extends outwardly from the venting port defined by an inner surface of the cutting head body.

10. The abrasive jet system of claim 1, further comprising:

at least one additional vent in the sidewall of the cutting head body, the at least one additional vent adapted to adjust a pressure in the cutting head body between the orifice mount receiving section and the mixing region.

11. The abrasive jet system of claim 1, wherein the isolator includes a passageway with an upstream converging section and a downstream diverging section.

12. The abrasive jet system of claim 1, wherein the isolator is made of a material that is harder than the material of the cutting head body.

13. The abrasive jet system of claim 1, further comprising:

a pressure sensor positioned to measure a pressure at a location in the cutting head body between the orifice mount receiving section and the mixing region.

14. The abrasive jet system of claim 13, wherein the pressure sensor is adapted to send at least one signal based, at least in part, on a measured pressure in an internal venting region that is adjacent to the vent port and through which a fluid jet produced by a jewel orifice passes before the fluid jet is mixed with abrasive passing through the abrasive feed port.

15. The abrasive jet system of claim 1, wherein the cutting head body includes an upper section and a lower section that mates with the upper section to define the venting through-hole, the upper section includes the orifice mount receiving section, and the lower section is adapted to receive a mixing tube.

16. The abrasive jet system of claim 15, wherein the venting through-hole is defined, at least in part, by a groove in one of the upper section and the lower section.

17. An abrasive waterjet cutting head comprising:

a cutting head body having a mixing region, an abrasive feed port through which abrasive moves into the mixing region, a venting port positioned upstream of the abrasive feed port and downstream of an orifice mount seating face of the cutting head body such that the venting port is downstream of a fluid jet exit of an orifice mount seated against the orifice mount seating face, and a venting passageway extending from the venting port through a sidewall of the cutting head body; and a pressure sensor positioned to measure a pressure at a location in the cutting head body between the orifice mount seating face and the mixing region.

18. The abrasive waterjet cutting head of claim 17, wherein the cutting head body further comprises a tubular surface defining the venting passageway, the tubular surface extending continuously and uninterruptedly from the venting port to an exterior surface of the cutting head body.

19. The abrasive waterjet cutting head of claim 17, wherein the venting passageway of the cutting head body extends radially outward from the venting port to an exterior surface of the cutting head body.

20. The abrasive waterjet cutting head of claim 17, wherein the venting passageway of the cutting head body is a through-hole extending through a tubular wall of the cutting head body to a venting chamber, the venting chamber being downstream of the orifice mount seating face.

21. The abrasive waterjet cutting head of claim 17, wherein the venting port of the cutting head body is located closer to the orifice mount seating face than the mixing region.

22. The abrasive waterjet cutting head of claim 17, wherein the venting port of the cutting head body has a diameter that is equal to or less than about 0.03 inch.

23. The abrasive waterjet cutting head of claim 17, further comprising:

an orifice member positioned along the venting passageway of the cutting head body.

24. The abrasive waterjet cutting head of claim 17, wherein the cutting head body further comprises an upstream section and a downstream section that mate and cooperate to define the venting passageway, the upstream section includes the orifice mount seating face.

25. A method for producing an abrasive waterjet, the method comprising:

delivering a fluid jet produced by a jet generating orifice through an orifice mount towards a mixing region in a cutting head body;

delivering abrasive through an abrasive feed port to the mixing region to entrain the abrasive in the fluid jet;

passing fluid through a venting port positioned upstream of the mixing region and downstream of the orifice mount to adjust pressure in at least a portion of a passageway in the cutting head body extending between the orifice mount and the mixing region; and delivering the fluid jet through an isolator positioned between the venting port and the mixing region.

26. The method of claim 25, further comprising:

pressurizing the fluid using a pressurization device to a pressure above atmospheric pressure before passing the fluid through the venting port.

27. The method of claim 25, wherein passing the fluid through the venting port includes passing ambient air, external to the cutting head body, through the cutting head body via a venting through-hole in a sidewall of the cutting head body.

28. The method of claim 27, wherein passing ambient air through the cutting head body includes passing the ambient air through an orifice member positioned along the venting through-hole.

29. The method of claim 25, wherein passing the fluid through the venting port includes delivering a sufficient amount of fluid through the venting port to keep the pressure in the passageway above the pressure in the mixing region while the abrasive is entrained in the fluid jet.

30. The method of claim 25, wherein passing the fluid through the venting port includes delivering a sufficient amount of the fluid through the venting port to produce a pressure differential between a first pressure in a section of the passageway adjacent to the orifice mount and a second pressure in the mixing region so as to substantially prevent abrasive in the mixing region from flowing upstream and reaching the orifice mount.

31. The method of claim 25, further comprising:

maintaining an upstream pressure in the passageway at or above a first pressure; and maintaining a mixing region pressure in the mixing region at or below a second pressure, the first pressure is at least 0.05 psi greater than the second pressure.

32. The method of claim 25, further comprising:

delivering a sufficient amount of the fluid through the venting port to keep the pressure in the passageway above a pressure in the mixing region while the abrasive is entrained in the fluid jet.

33. The method of claim 25, further comprising:

passing the fluid through a vent passageway extending through a sidewall of the cutting head body before passing the fluid through the venting port.

34. The method of claim 33, wherein the vent passageway is a substantially straight passageway.

35. The method of claim 33, wherein an orifice member is positioned along the vent passageway.

36. The method of claim 25, further comprising:

passing fluid through another venting port positioned upstream of the mixing region and downstream of the orifice mount.

37. The abrasive jet system of claim 1, wherein the orifice mount receiving section includes a shoulder that abuts the orifice mount, the venting port is positioned downstream of the shoulder.

38. The abrasive waterjet cutting head of claim 17, wherein the cutting head body includes a shoulder with the orifice mount seating face which abuts the orifice mount, the venting port is positioned downstream of the shoulder.

39. The method of claim 25, further comprising:

measuring a pressure using a pressure sensor positioned between the venting port and the mixing region.

40. An abrasive jet system having a nozzle assembly for producing an abrasive jet, the abrasive jet system comprising:

a cutting head body of the nozzle assembly including an orifice mount receiving section adapted to receive an orifice mount for retaining a jewel orifice, a mixing region positioned downstream of the orifice mount receiving section, an abrasive feed port through which abrasive moves into the mixing region, and a cutting head vent having a venting port and a venting through-hole extending outwardly from the venting port through a sidewall of the cutting head body, the venting port positioned between the orifice mount receiving section and the mixing region such that the venting port is downstream of a fluid jet exit of an orifice mount in the orifice mount receiving section during use; and a pressure sensor positioned to measure a pressure at a location in the cutting head body between the orifice mount receiving section and the mixing region.

41. The abrasive jet system of claim 40, wherein the pressure sensor is adapted to send at least one signal based, at least in part, on a measured pressure in an internal venting region that is adjacent to the vent port and through which a fluid jet produced by a jewel orifice passes before the fluid jet is mixed with abrasive passing through the abrasive feed port.

42. An abrasive waterjet cutting head comprising:

a cutting head body having a mixing region, an abrasive feed port through which abrasive moves into the mixing region, a venting port positioned upstream of the abrasive feed port and downstream of an orifice mount seating face of the cutting head body such that the venting port is downstream of a fluid jet exit of an orifice mount seated against the orifice mount seating face, and a venting passageway extending from the venting port through a sidewall of the cutting head body; and an isolator mounted in the cutting head body and positioned between the venting port and the mixing region.

43. The abrasive waterjet cutting head of claim 42, wherein the isolator includes a passageway with an upstream converging section and a downstream diverging section.

44. A method for producing an abrasive waterjet, the method comprising:

delivering a fluid jet produced by a jet generating orifice through an orifice mount towards a mixing region in a cutting head body;

delivering abrasive through an abrasive feed port to the mixing region to entrain the abrasive in the fluid jet;

passing fluid through a venting port positioned upstream of the mixing region and downstream of the orifice mount to adjust pressure in at least a portion of a passageway in the cutting head body extending between the orifice mount and the mixing region; and measuring a pressure using a pressure sensor positioned between the venting port and the mixing region.

* * * * *